US008040137B2

(12) United States Patent
Agneray et al.

(10) Patent No.: US 8,040,137 B2
(45) Date of Patent: Oct. 18, 2011

(54) METHOD FOR MEASURING AN IONIZATION CURRENT OF A SPARK PLUG OF THE TYPE WITH RESONANT STRUCTURE AND CORRESPONDING DEVICE

(75) Inventors: Andre Agneray, Boulogne Billancourt (FR); Clement Nouvel, Verneuil sur Seine (FR)

(73) Assignee: Renault S.A.S., Boulogne Billancourt (FR)

( * ) Notice: Subject to any disclaimer, the term of this patent is extended or adjusted under 35 U.S.C. 154(b) by 442 days.

(21) Appl. No.: 12/162,620

(22) PCT Filed: Mar. 9, 2007

(86) PCT No.: PCT/FR2007/050899

§ 371 (c)(1),
(2), (4) Date: Nov. 28, 2008

(87) PCT Pub. No.: WO2007/113407

PCT Pub. Date: Oct. 11, 2007

(65) Prior Publication Data

US 2009/0153142 A1 Jun. 18, 2009

(30) Foreign Application Priority Data

Apr. 3, 2006 (FR) ..... 06 02883

(51) Int. Cl.
*F02P 17/00* (2006.01)

(52) U.S. Cl. ..... 324/393; 324/384

(58) Field of Classification Search ..... 324/378–382, 324/393, 399, 384

See application file for complete search history.

(56) References Cited

U.S. PATENT DOCUMENTS 5,801,534 A * 9/1998 Hohner et al. ..... 324/399

FOREIGN PATENT DOCUMENTS

| | | |
|---|---|---|
| DE | 3006665 | 9/1981 |
| DE | 19524539 | 11/1996 |
| DE | 1991 2376 | 9/2000 |
| DE | 10350850 | 5/2004 |
| EP | 0825343 | 2/1998 |

* cited by examiner

*Primary Examiner* — Vincent Q Nguyen

(74) *Attorney, Agent, or Firm* — Oblon, Spivak, McClelland, Maier & Neustadt, L.L.P.

(57) ABSTRACT

A device for measuring an ionization current of a spark plug of a type with a resonant structure, including a motor vehicle ignition system, the spark plug being coupled to a generator including a regulating capacitor. The generator includes a polarizer that polarizes the spark plug, connected between the generator and the spark plug, and a device that measures ionization current of the spark plug, connected between the regulating capacitor and ground.

8 Claims, 4 Drawing Sheets

METHOD FOR MEASURING AN IONIZATION CURRENT OF A SPARK PLUG OF THE TYPE WITH RESONANT STRUCTURE AND CORRESPONDING DEVICE

BACKGROUND OF THE INVENTION

The present invention relates, generally, to the measurement of an ionization current of a spark plug, in particular of resonant structure type spark plugs, used in ignition systems for motor vehicles.

The invention is particularly suitable for so-called "radiofrequency" ignition systems comprising multiple-spark type resonant structure spark plugs or BME.

These ignition systems using alternating currents are described, for example, in the French patent applications FR 2 859 830, FR 2 589 869 and FR 2 859 831, in the name of the Applicant.

At the end of the compression cycle, the spark plug is responsible for forming an electrical arc, the energy of which is sufficient to trigger the process of ignition of the gaseous mixture contained in the combustion chamber of the engine.

This electrical arc corresponds to the ionization of the gaseous mixture located between the electrodes of the spark plug, respectively a positive central electrode and a ground electrode.

However, on combustion of the mixture, after the spark has been generated by the spark plug, the flame edge can be propagated. Its blast can push back a portion of the mixture against the walls of the cylinder and the top of the piston.

The rise in pressure and temperature is so great that the fuel can remain jammed against the walls, reach its self-ignition point and then ignite in several places.

The result of this is microexplosions producing vibrations in the acoustic domain (between approximately 5 and 10 kHz). These vibrations are very strong and can rapidly create hot spots which further accentuate the problem. The accumulation of microexplosions will break off or melt a small quantity of metal on top of the piston and/or on the walls of the cylinder, which can, after some time, result in the destruction of the piston and of the walls of the cylinder.

It is possible to detect the appearance of these knock phenomena, by measuring the ionization current, that is, the current passing through the spark plug. In practice, an ionization current appears through the spark plug as if a resistor were temporarily placed at the terminals of the electrodes (according to a first approximation).

For this, the measurement means or sensors must be able to operate in a very narrow bandwidth, for example of around 7 kHz.

SUMMARY OF THE INVENTION

One aim of the invention is to propose means of measuring the polarization current in the case of resonant structure type spark plugs.

Another aim of the invention is to propose measurement means that are accurate enough to be able to work in the desired narrow frequency bandwidth.

To this end, the invention proposes a method of measuring an ionization current of a resonant structure spark plug, used in an ignition system for a motor vehicle, in which, during an ignition phase, said spark plug is powered by a voltage generated using a previously charged control capacitor.

According to a general characteristic of this aspect of the invention, said ionization current is measured periodically, between two ignition phases, between said control capacitor and the ground, after having polarized the spark plug.

In other words, instead of measuring the ionization current on the spark plug, which is what would be required to solve the problem, this ionization current is measured directly on a control capacitor which powers the spark plug by being discharged.

Consequently, the measurement inaccuracy is minimized.

According to one embodiment, said ionization current is measured using measurement means connected between said control capacitor and ground, short circuited during the ignition phases.

In other words, the measurement means are connected only between two ignition phases.

According to another embodiment, the ionization current is measured on completion of a damping phase during which the current passing through the spark plug progressively decreases.

According to another aspect of the invention, there is proposed a device for measuring an ionization current of a resonant structure spark plug, used in an ignition system for a motor vehicle, said spark plug being coupled to a generator comprising a control capacitor.

According to a general characteristic of this other aspect of the invention, said generator also comprises polarization means able to polarize the spark plug, connected between the generator and said spark plug and means of measuring the ionization current of said spark plug, connected between the control capacitor and ground.

Thus, since the measurement means are connected between the control capacitor and ground and not directly to the terminals of the spark plug, it is possible to choose a polarization resistor for the spark plug that is of low value, suited to the intensity of the ionization current, which is generally less than 1 mA, and to a particular frequency band, for example the frequency band in which the knock phenomena are observed.

Preferably, the device can also comprise controllable short-circuit means, able to short circuit the measurement means.

For example, the measurement means can comprise a measurement resistor.

According to one embodiment, the short-circuit means can comprise a short-circuit transistor connected between the control capacitor and ground, and controlled by a short-circuit voltage generator, and a polarization power supply connected between the measurement resistor and ground, and able to polarize said short-circuit transistor.

According to one embodiment, the polarization power supply can comprise, on the one hand, a power supply resistor and a local power supply connected in series, and on the other hand a power supply capacitor connected in parallel to the power supply resistor and the local power supply, between the measurement resistor and ground.

BRIEF DESCRIPTION OF THE DRAWINGS

Other characteristics and advantages of the invention will become apparent from studying the detailed description of an embodiment of the invention, by no means limiting, and the appended drawings, in which.

DETAILED DESCRIPTION OF THE INVENTION

Figure 1:
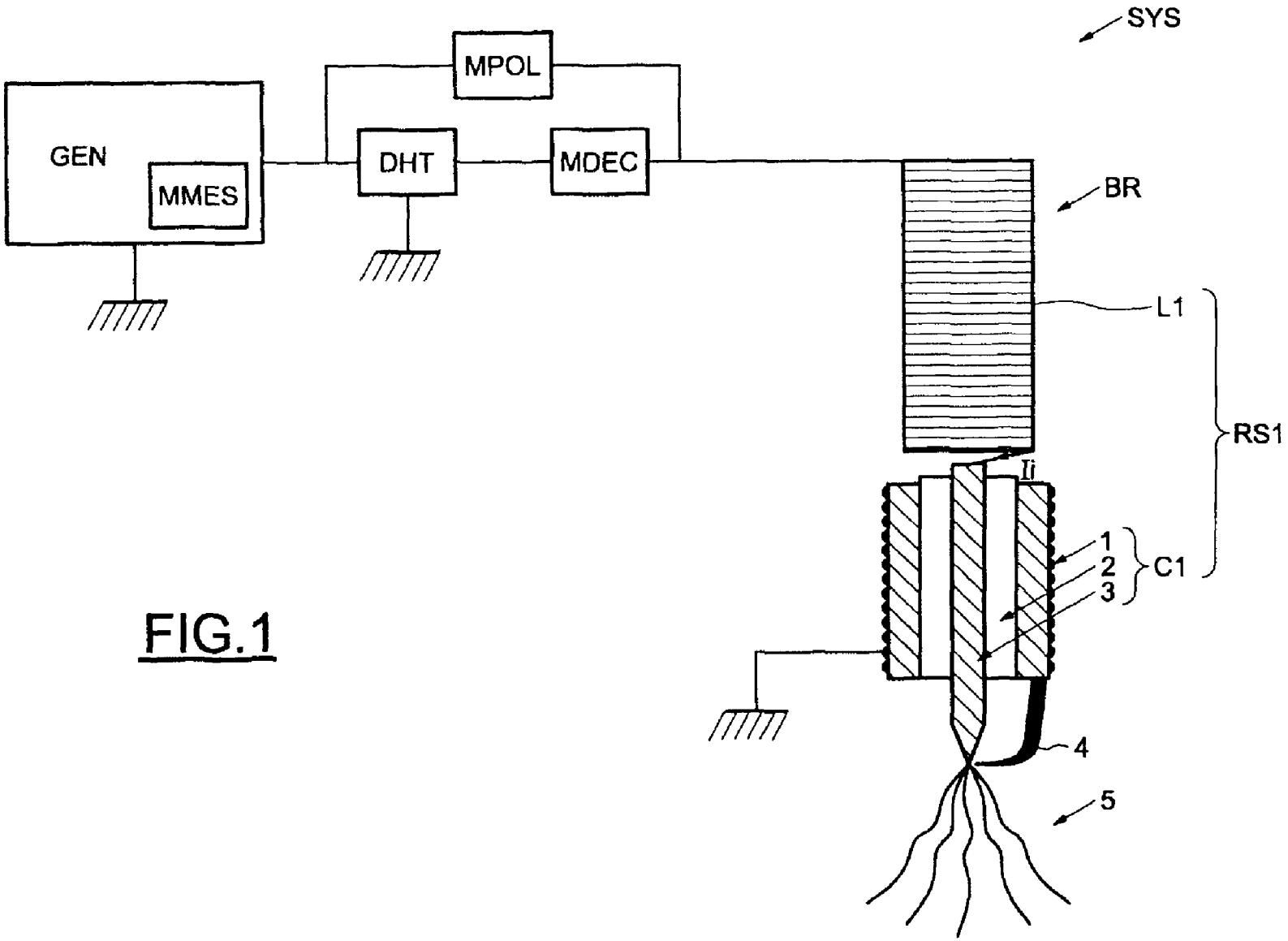
FIG. 1 illustrates one embodiment of the invention.

In FIG. 1, the reference SYS represents an ignition system for motor vehicles comprising a spark plug BR of resonant structure type, well known to those skilled in the art, and described, for example, in the French patent applications FR 2 859 830, FR 2 589 869 and FR 2 859 831, in the name of the Applicant.

An ionization current Ii circulates through the spark plug BR.

More specifically, as illustrated diagrammatically in FIG. 1, the spark plug BR comprises a resonant assembly RS1 (called spark plug coil), comprising an inductive coil L1 and a capacitor C1 which in this example comprises a shell 1-ceramic 2-central electrode 3 assembly.

The spark plug BR is connected to a generator GEN able to generate a high-value voltage called "intermediate voltage". This high voltage is directed by the central electrode 3 of the capacitor C1. An electric arc is produced when the current passes between the central electrode 3 and a ground electrode 4, generating a spark 5.

The spark plug BR is connected to the generator GEN via a DHT stage called "high voltage pilot" connected in series with decoupling means MDEC. The polarization means of the spark plug MPOL are connected in parallel to the high voltage pilot DHT and to the decoupling means MDEC.

The generator GEN comprises measurement means MMES able to measure the ionization current Ii circulating through the spark plug BR.

Figure 2:
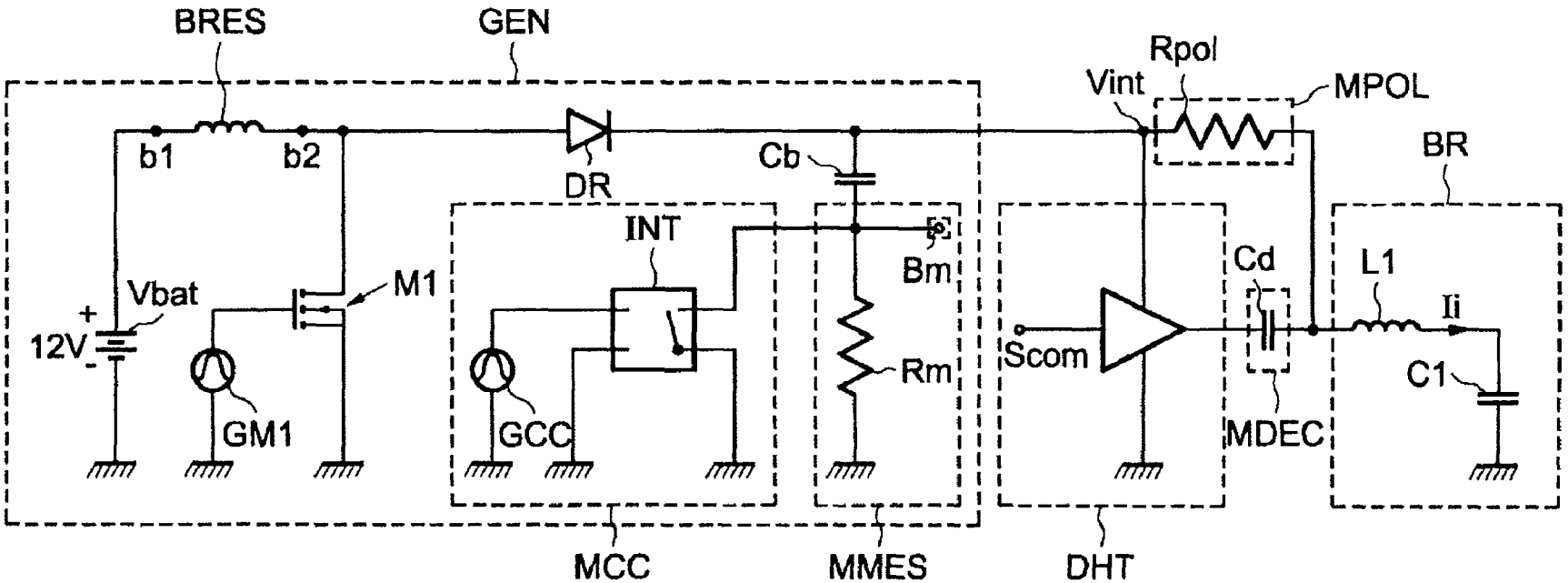
FIG. 2 more accurately illustrates an embodiment of the invention.

With reference to FIG. 2, this figure illustrates in more detail an embodiment of the blocks of the system SYS according to the invention.

The generator GEN can be produced using a voltage step-up assembly of the "boost" type, according to the expression used by those skilled in the art.

The generator GEN comprises a power supply Vbat, in this case a 12 volt power supply, able to charge a so-called "reservoir" coil BRES connected by a first terminal b1 to the power supply Vbat. The loading of the coil BRES is controlled by a transistor M1 connected between the other terminal b2 of the coil BRES and ground. The transistor M1 is controlled by a voltage generator GM1.

The reservoir coil BRES is discharged into the part of the circuit connected to its terminal b2, via a rectifier diode DR, at a voltage greater than the voltage of 12 volts delivered by the power supply Vbat. This relatively high voltage is called "intermediate voltage" Vint. It is around 100 volts. So as to keep this intermediate voltage Vint more or less constant, the generator GEN comprises a so-called "ballast" capacitor Cb connected to the output of the rectifier diode DR.

The generator GEN is linked to the high voltage pilot DHT powered by the intermediate voltage Vint, and controlled by a control signal Scom by the control means MCOM.

The control signal Scom directly originates the creation and the generation of sparks by the spark plug BR.

Figure 3:
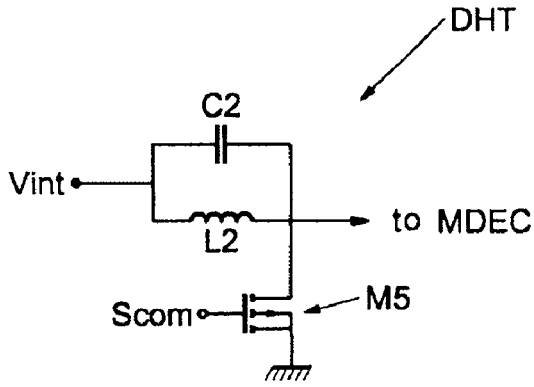
FIG. 3 represents in more detail a module of an embodiment of the invention.

FIG. 3 illustrates an exemplary embodiment of the high voltage pilot DHT.

This comprises a system formed by a coil L2 and capacitor C2 connected in parallel, receiving the intermediate voltage Vint as input.

The assembly L2-C2 is linked at its output to a control transistor M5 receiving on its control electrode the control signal Scom.

The control signal Scom corresponds to a pulse train, generated periodically.

Thus, on each pulse train, the transistor M5 charges the coil L2, which resonates with the capacitor C2 and the resonant assembly RS1, so as to produce high voltage pulses at the natural frequency of the spark plug BR.

When the resonant assembly RS1 is excited at its natural frequency, and its quality figure is high (for example greater than 40), the result is a very high voltage at the terminals of the capacitor C1. The central electrode of the spark plug BR, which is one of the terminals of the capacitor C1, is then raised to a very high voltage capable of triggering sparks.

Reference is again made to FIG. 2.

The excitation generated by the high voltage pilot DHT is transmitted to the resonant structure RS1 of the spark plug BR via decoupling means MDEC, in this case a decoupling capacitor Cd.

The decoupling capacitor Cd prevents the continuous link between the intermediate voltage Vint and the central electrode of the spark plug 3. This break in the link makes it possible to prevent electric shocks or electrocutions for people.

Moreover, if an "electric arc" type discharge were to start, this would result in a rapid destruction of the electrodes, in particular of the central electrode 3. In fact, if a spark with a sufficiently strong conductivity is created between the central electrode and ground, the voltage drop generated can fall below the intermediate voltage Vint. All the charges accumulated in the capacitor Cd are then transferred in the link created by the spark. This transfer of charges is performed with high currents which can damage the central electrode 3.

The function of the decoupling capacitor Cd is to prevent this type of charge transfer.

As a variant, the generator can be a transformer, of step-up type, which prevents the transfer of direct current. In this case, the use of a decoupling capacitor is no longer necessary.

So as to be able to measure the ionization current, polarization means MPOL are used to maintain a preferably positive polarization after the generation of the spark, on the central electrode 3 of the spark plug BR.

Conventionally, the polarization means MPOL can be formed by a resistor Rpol connected between the output of the rectifier diode DR delivering the intermediate voltage Vint and the output of the decoupling means MDEC, in this case the capacitor Cd.

A simple solution for then measuring the ionization current would be to connect to the terminals of the polarization resistor Rpol an assembly able to divide the value of the voltage, convert the value of the duly divided voltage into current and then measure it.

These conventional assemblies that are well known to those skilled in the art can be produced using a differential amplifier with discrete transistor, or an operational amplifier, or even using an assembly using current mirrors. However, these assemblies, including a voltage divider, reduce the accuracy needed for a measurement of a very weak ionization current.

Unlike these solutions, the invention involves using a polarization resistor with a low value so as to retain a maximum of accuracy in measuring the ionization current, and to couple the measurement means, not to the terminals of the polarization resistor Rpol, but between the capacitor Cb and ground, within the generator GEN.

These measurement means MMES comprise a measurement resistor Rm and a measurement terminal Bm where the ionization current is measured.

Furthermore, these measurement means MMES are associated with short-circuit means MCC comprising a switch INT connected in parallel to the measurement resistor Rm, this switch INT being controlled by a short-circuit generator GCC.

The switch is preferably rapid and of very low impedance.

Figure 4:
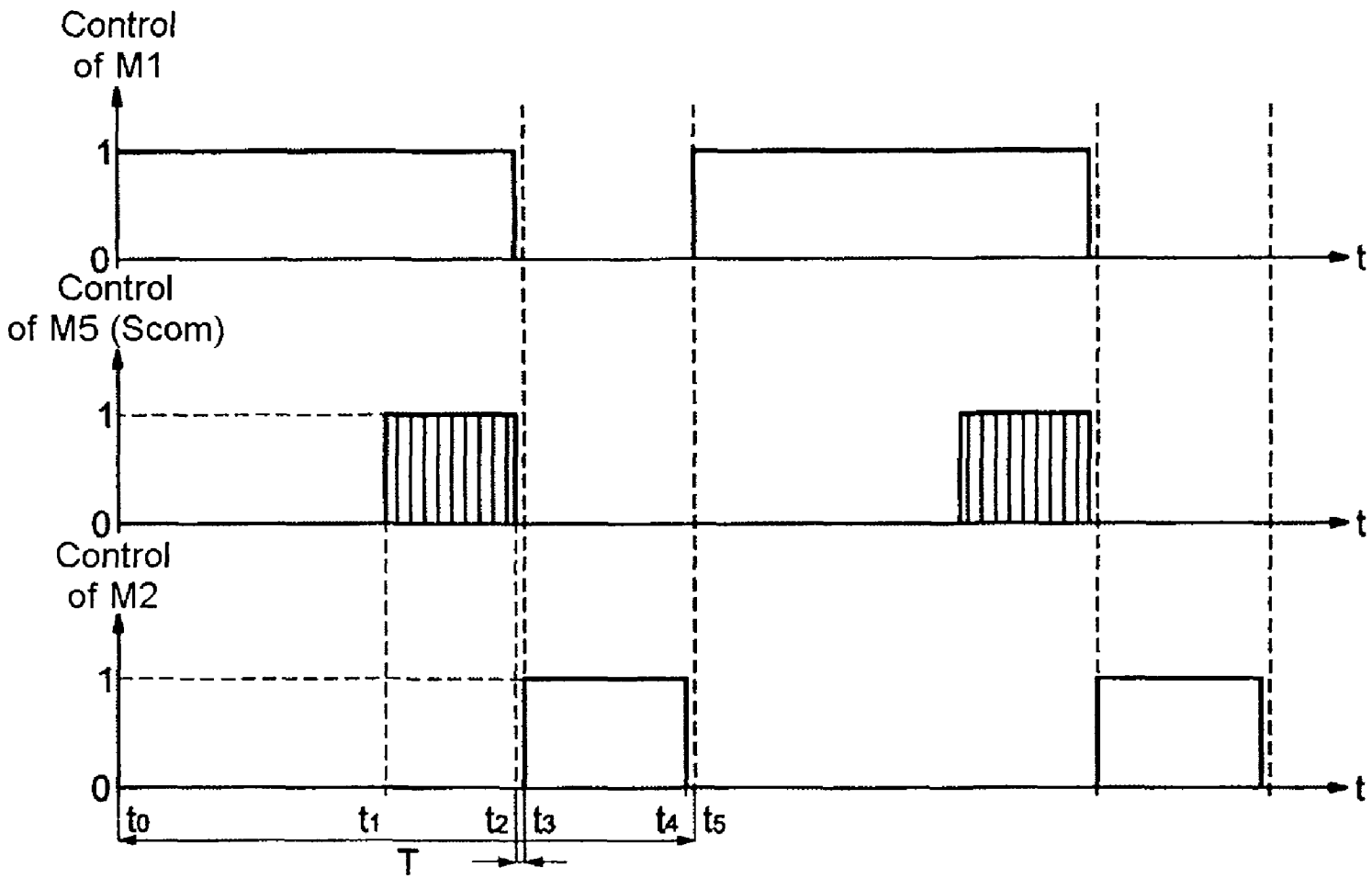
FIG. 4 represents a timing diagram of various steps of an embodiment of the invention.

FIG. 4 illustrates the various steps of a mode of operation of the invention, during a period T.

At the instant t0, the transistor M1 becomes passing and enables the capacitor Cb to be charged.

At an instant t1, the control signal Scom controls the transistor M5, using a pulsed control signal (the pulsing being, for example, at the frequency of 5 MHz), triggering the ignition phase proper, and the generation of sparks by the spark plug BR. At the instant T2, the control signal becomes inactive once again.

During a damping phase (between t2 and t3), the ignition current (having a high amplitude) is naturally and progressively attenuated within the spark plug BR, because of the existence of spurious resistances.

Between the instants t0 and t3, the short-circuit means are active and short circuit the measurement resistor. Consequently, the capacitor Cb is connected between the rectifier diode DR and ground.

At the instant t3, the transistor M2 renders the short-circuit means inactive, and the capacitor Cb is then discharged through the measurement resistor Rm. The discharge current of the capacitor Cb corresponds to the ionization current which circulates through the resistor Rpol, in the spark plug BR, then in the combustion mixture.

The value of the ionization current is then measured on the measurement terminal Bm.

The measurement phase ends at an instant t4, and at an instant t5 another charging, ignition and measurement cycle is repeated.

Figure 5:
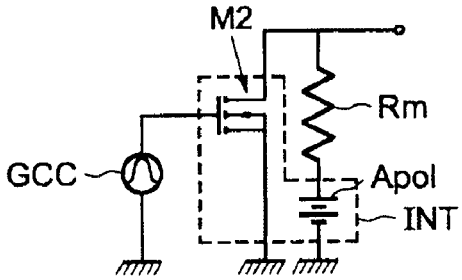
FIGS. 5 and 6 represent embodiments of another block of the invention.

FIG. 5 represents an embodiment of the switch INT. In this example, the controllable switch is implemented by a transistor, in this case of MOS type, M2, the control electrode of which is connected to the generator GCC. In order to counteract the effect of the structural diode of the MOS transistor M2, a polarization is introduced using a polarization power supply Apol connected between the measurement resistor Rm and ground.

Figure 6:
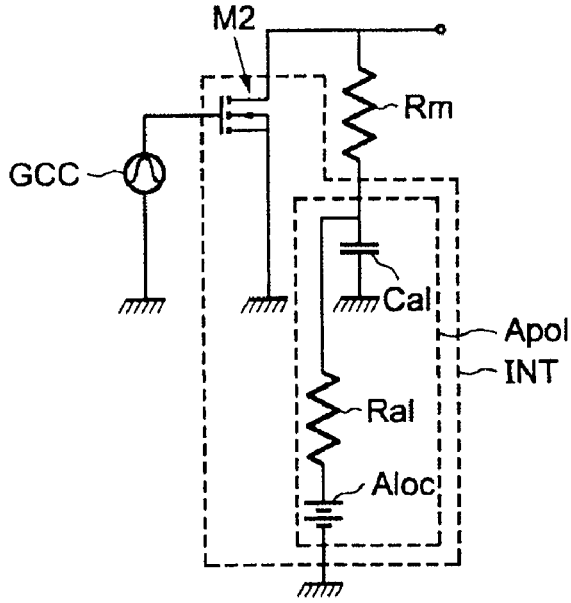

In FIG. 6, an embodiment of this polarization power supply Apol is represented.

In this example, the polarization power supply Apol comprises a capacitor Cal linked to a local power supply Aloc via a power supply resistor Ral. The local power supply Aloc can, for example, be a battery voltage or a 5 volt power supply.

Those skilled in the art will know how to dimension the components used, so as to know the voltage Val at the terminals of the capacitor Cal. From this voltage value Val, the ionization current Ii can be deduced by the relation:

$$Ii=(\text{Voltage_}Apol-\text{Voltage_}Bm)/Rm$$

The invention therefore makes it possible to measure the ionization current very accurately, and within a well defined frequency range, for example suited to detecting knock phenomena.

The invention claimed is:

1. A method of measuring an ionization current of a resonant structure spark plug, used in an ignition system for a motor vehicle, in which, during an ignition phase, the spark plug is powered by a voltage generated using a previously charged control capacitor, the method comprising:

measuring an ionization current periodically, between two ignition phases, with a measurement mechanism connected between the control capacitor and ground, after having polarized the spark plug.

2. The method as claimed in claim 1, wherein the measurement mechanism, is short circuited during the ignition phase.

3. The method as claimed in claim 1, in which the ionization current is measured on completion of a damping phase during which the current passing through the spark plug progressively decreases.

4. A device for measuring an ionization current of a resonant structure spark plug, used in an ignition system for a motor vehicle, the spark plug being coupled to a generator including a control capacitor, the generator including a polarization unit which polarizes the spark plug, connected between the generator and the spark plug, the device comprising:

a measurement mechanism which measures the ionization current of the spark plug, and is connected between the control capacitor and ground.

5. The device as claimed in claim 4, further comprising a controllable short-circuit unit to short circuit the measurement mechanism.

6. The device as claimed in claim 5, in which the measurement mechanism includes a measurement resistor.

7. The device as claimed in claim 5, in which the short-circuit unit includes a short-circuit transistor connected between the control capacitor and ground, and controlled by a short-circuit voltage generator, and a polarization power supply connected between a measurement resistor and ground, and to polarize the short-circuit transistor.

8. The device as claimed in claim 7, in which the polarization power supply comprises a power supply resistor and a local power supply connected in series, and a power supply capacitor connected in parallel to the power supply resistor and the local power supply, between the measurement resistor and ground.

* * * * *